US006646366B2

(12) United States Patent
Hell et al.

(10) Patent No.: US 6,646,366 B2
(45) Date of Patent: Nov. 11, 2003

(54) DIRECTLY HEATED THERMIONIC FLAT EMITTER

(75) Inventors: Erich Hell, Erlangen (DE); Detlef Mattern, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/202,525

(22) Filed: Jul. 24, 2002

(65) Prior Publication Data

US 2003/0025429 A1 Feb. 6, 2003

(30) Foreign Application Priority Data

Jul. 24, 2001 (DE) ..... 101 35 995

(51) Int. Cl.[7] ..... H01J 35/06

(52) U.S. Cl. ..... 313/310; 313/329; 313/341; 313/346 R; 313/346 DC

(58) Field of Search ..... 313/341, 342, 313/343, 310, 337, 629, 346 R, 346 DC, 329, 378, 119, 134, 136; 430/942; 436/173

(56) References Cited

U.S. PATENT DOCUMENTS 6,115,453 A 9/2000 Hell et al.
6,426,587 B1 7/2002 Hell et al.
2001/0052743 A1 * 12/2001 Hell et al. ..... 313/341

* cited by examiner

*Primary Examiner*—Ashok Patel
*Assistant Examiner*—Sharlene Leurig
(74) *Attorney, Agent, or Firm*—Schiff Hardin & Waite

(57) ABSTRACT

A directly heated thermionic flat emitter has an emission surface divided by slots into interconnects that have respective terminal lugs forming power leads arranged at a peripheral edge. A number of segments are connected by respective narrow webs to the outermost interconnects of the emitter but have no connection to one another. The webs are arranged and dimensioned such that practically no current can flow from the interconnects to the segments and so that thermal conduction to the segments is largely suppressed.

5 Claims, 2 Drawing Sheets

DIRECTLY HEATED THERMIONIC FLAT EMITTER

BACKGROUND OF THE INVENTION

1. Field of the Invention

The present invention is directed to a directly heated thermionic flat emitter of the type having an emission surface divided by slots with a number of interconnects, and having a terminal lug at a periphery of the emission surface for connection to a power lead.

2. Description of the Prior Art

Thermionic flat emitters of the aforementioned type as disclosed, for example, in U.S. Pat. No. 6,115,453 and German OS 100 16 125 are utilized in X-ray tubes, particularly in rotating bulb X-ray tubes. That part of the emitter forming the emission surface is usually fashioned circular or disk-like and is composed of a thin tungsten sheet approximately 100 $\mu$m thick. The emission surface is heated to above 2000° C. in order to emit electrons during operation. Emission of electrons then occurs everywhere where an adequately high electrical field extracts the emitted electrons. The electron optics is thereby determined by all potential-carrying elements in the proximity of the emitter. The seating of the emitter relative to the cathode head has a particular influence on the shape of the focal spot as well as on the distribution of the focal spot on the anode. In order to avoid shorts between the emitter and the cathode head, the bore in the cathode head is selected approximately 0.4 mm larger than the diameter of the emitter. It has been shown that the gap of approximately 0.2 mm that thereby exists at each side between the emitter and the cathode head bends the electron trajectories in the edge region of the emitter. This effect has a negative influence on the focal spot occupation and thus ultimately on the image quality of the X-ray image produced with the tube. This disadvantage can be partially compensated by placing the emitter deeper in the head but cannot be entirely eliminated.

Placing the emitter deeper leads to another negative effect, namely that the electrons are emitted proceeding from the back side of the emitter.

These two effects—the bending of the electrical field and the emission of the electrons from the back side of the emitter—contribute to a halo in the focal spot occupation of the rotating bulb tube. This halo ultimately degrades the image quality in the practical utilization of the rotating bulb tube, for example in computed tomography.

SUMMARY OF THE INVENTION

An object of the present invention is to eliminate the aforementioned disadvantages in a directly heated thermionic emitter of the type initially described that is employable, in particular, in rotating bulb X-ray tubes. In particular, a bending of the electron trajectories in the edge region of the emitter and an electron emission from the back side of the emitter are to be avoided.

The above object is achieved in accordance with the invention in a directly heated thermionic emitter having an emission surface which is divided by slots into a number of interconnects. A number of segments surround a periphery of the emission surface. The segments are not connected to each other and are connected to interconnects at the peripheral region of the emission surface by webs. The webs are spaced and dimensioned so that no current flows from the interconnects to the segments, and so that there is no appreciable heat transfer from the emission surface to the segments.

As a result of the inventive proposed arrangement of segments, an additional, non-emitting ring is formed around the emitter that causes the equipotential surfaces to be undistorted at the edge of the actual emitting surface of the emitter. The ring creates a larger distance between the gap at the cathode head and the outer edge of the emission surface of the emitter, as a result of which the influence on the electron trajectories is kept negligibly small. The additional ring created in this way also effects a reduction of the field strength at the back side of the emitter, so that fewer electrons are extracted from the back side of the emitter.

DESCRIPTION OF THE PREFERRED EMBODIMENTS

Figure 1:
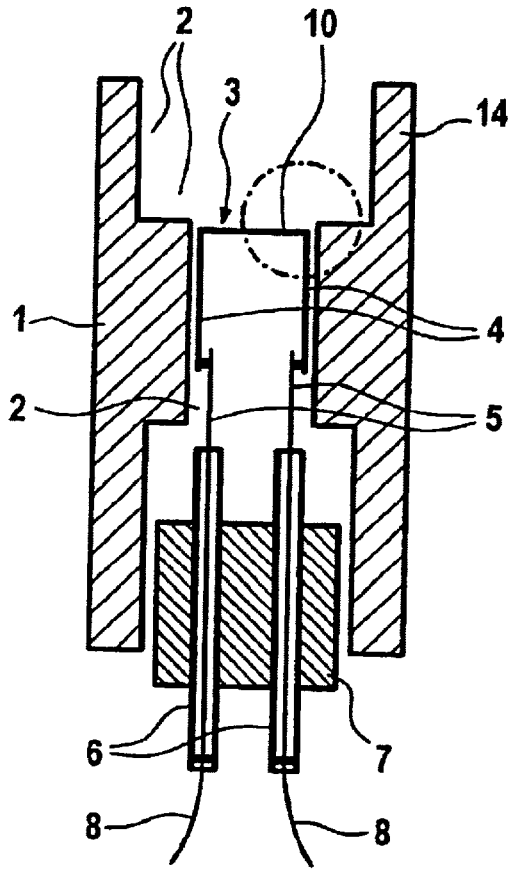
FIG 1 (PRIOR ART)
FIG. 1 is a section through a cathode of an electron beam tube with a directly heated flat emitter of a conventional type.

FIG. 1 shows a simplified illustration of a cathode of an X-ray tube with a Wehnelt cylinder 1 having a central bore 2 in which a flat emitter 3 is arranged. The flat emitter 3 has a circular emission surface 10 and is provided with terminal lugs 4 that are welded to power supply rods 5. In addition to the function of power feed, the terminal lugs 4 also assume the function of mechanically holding the emitter 3. The power supply rods 5 are conducted toward the outside through tubes 6 in an insulator block 7 where they are connected to electrical lead wires in a known way.

Figure 2:
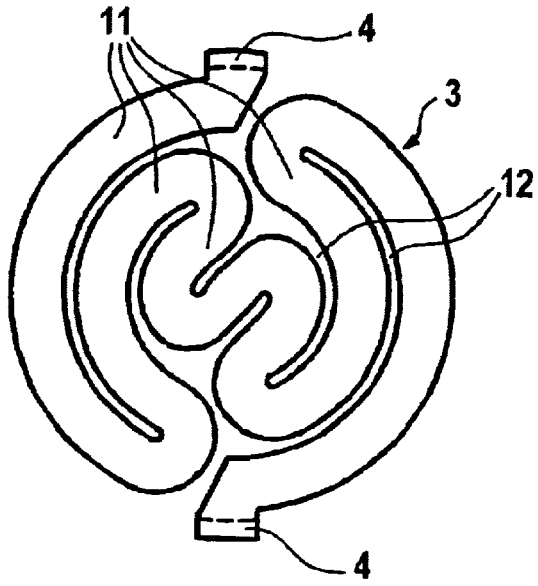
FIG 2 (PRIOR ART)
FIG. 2 is a plan view of the conventional emitter of FIG. 1.

FIG. 2 shows the flat emitter 3 in a plan view. The emitter surface 10 has an outside diameter of about 5 mm and is formed by interconnects 11 that proceed in a serpentine-like fashion. The interconnects 11 are formed by slots 12 that are cut with a laser into a thin tungsten sheet. The terminal lugs 4 are bent downwardly perpendicular to the plane of the emission surface.

Figure 3:
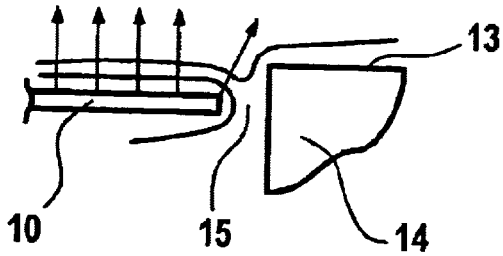
FIG 3 (PRIOR ART)
FIG. 3 is an enlarged a magnified excerpt from FIG. 1.

The initially addressed problem is discussed on the basis of FIG. 3, which shows an enlarged view of the excerpt indicated with broken lines in FIG. 1.

The emitter surface 10 is set deeper by about 100 $\mu$m compared to the base 13 of the cathode head 14. In order to avoid shorts between the emitter and the cathode head, the bore 2 is kept about 0.4 mm larger than the emitter diameter. The gap 15 that thereby exists bends the electron trajectories in the edge region of the emitter during operation. This effect is visualized by means of the illustration of the electrical field lines with the oblique orientation of the one arrow.

As already mentioned, the bending of the electron trajectories in the edge region and the electron emission from the back side of the emitter contribute to a halo in the focal spot occupation of the rotating bulb tube. This halo deteriorates the MTF (modulation transfer function) and thus the image quality, particularly given employment in CT technology.

Figure 4:
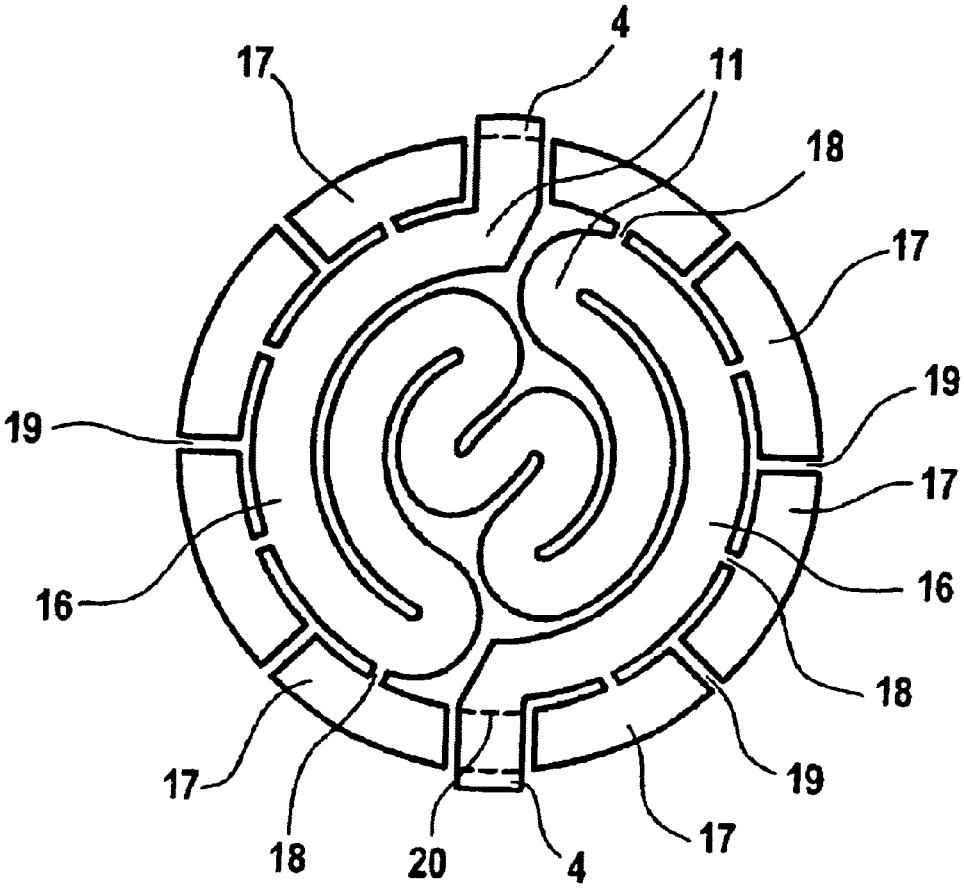
FIG. 4 is a plan view of a first embodiment of an emitter according to the invention.
Figure 5:
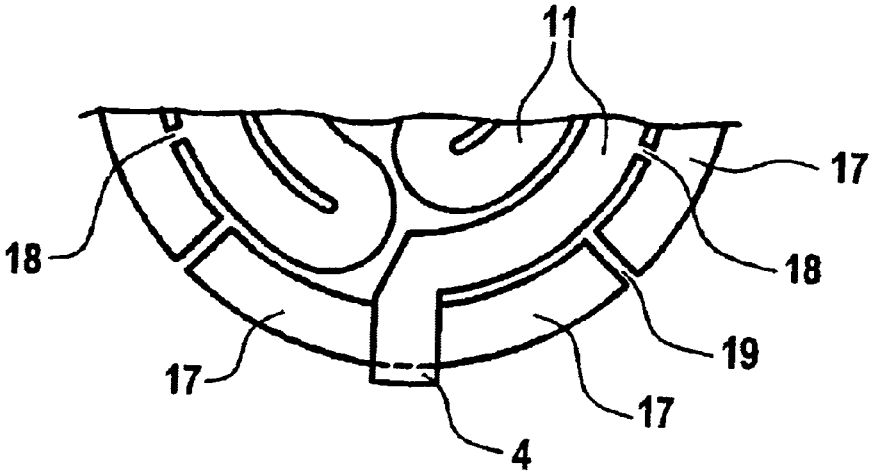
FIG. 5 is a plan view onto a part of a second embodiment of an emitter according to the invention.

The embodiments presented in FIGS. 4 and 5 eliminate these disadvantages.

In the emitter shown in a plan view in FIG. 4, a number of annular segments 17 are attached to the two outer sections 16 of the interconnects 11, the totality of the segments 17 forming an annular contour. The attachment occurs by means of narrow webs 18 that are approximately 100 through 200 μm wide. A narrow gap 19 is situated between the individual segments 17; the segments thus are not directly connected to one another.

The width of each web 18 is dimensioned such that no noteworthy current from the interconnects can flow across the web 18 into the respective segments 17. Accordingly, no pronounced heating and thus no temperature elevation due to thermal conduction occur in the segments 17. The outer ring formed by the segments 17 therefore remains largely cold, so that the segments cannot emit any electrons. A (slight) heat nonetheless conveyed via the webs 18 is in turn eliminated from the segments 17 by radiation.

As shown, the right-angled folding of the terminal lugs 4 can ensue in the region of the outer contour of the segments 17 or—as shown with broken lines (position 20 in. FIG. 4)—can ensue in the region of the inside contour of the segments 17.

In the embodiment according to FIG. 5, the terminal lugs 4 of neighboring segments 17 are not connected via webs 18 but are directly arranged at the ends of the interconnects. Expediently, this connection can be produced with appropriate laser cuts during manufacture of the emitter. In this case, the folding of the terminal lugs 4 expediently ensues somewhat farther toward the outside.

As a result of the additional ring formed by the segments 17 at which no electron emission occurs, a uniform, straight course of the electron trajectories as well as a homogeneous field line course exists everywhere when viewing FIG. 3. First, the gap through which electrons could emerge in unwanted fashion is reduced to the cut width of the laser of a few 10 μm; second, the equipotential surfaces also remain undistorted at the edge of the emitting interconnects. The gap relative to the cathode head required for protection against shorts now is much larger as a result of the width of the additional segments 17 than in embodiments of the prior art. There is thus considerably less influence on the electron trajectories. Electrons from the back side of the emitter must produce around the outer, segmented ring in order to reach the front side. Since the field strength at the back side is greatly reduced by the additional ring, emission proceeding from the back side of the emitter is negligibly low.

The inventive measures can be applied not only to the emitters fashioned in serpentine configurations as in the illustrated exemplary embodiments; but also the solution of an additional ring around the flat emitter can be applied to other flat emitters as disclosed, for example, in German OS 10 029 253.

Although modifications and changes may be suggested by those skilled in the art, it is the intention of the inventors to embody within the patent warranted hereon all changes and modifications as reasonably and properly come within the scope of their contribution to the art.

We claim as our invention:

1. A directly heated thermionic flat emitter comprising:

a flat emission surface having a peripheral edge, said flat emission surface having a plurality of slots therein dividing said emission surface into a plurality of interconnects including outermost interconnects located at said peripheral edge, each of said interconnects having a terminal lug for power supply disposed at said peripheral edge; and a plurality of segments surrounding said peripheral edge of said emission surface and being respectively connected to said outermost interconnects by a plurality of narrow webs, said segments having no connection to each other and said webs being located and dimensioned so that substantially no current flows from said outer interconnects to the respective segments and so that thermal conduction to said segments is substantially suppressed, said segments forming a peripheral non-emitting region surrounding said emission surface.

2. A directly heated thermionic flat emitter as claimed in claim 1 wherein said emission surface is circular, and wherein said segments are annular segments.

3. A directly heated thermionic flat emitter as claimed in claim 1 wherein each of said segments has one web connecting that segment to one of said outermost interconnects.

4. A directly heated thermionic flat emitter as claimed in claim 1 wherein said segments include segments neighboring said terminal lugs, and wherein said segments neighboring said terminal lugs are directly connected to said terminal lugs.

5. A directly heated thermionic flat emitter as claimed in claim 1 wherein each of said webs has a width and each of said interconnects has a width, and wherein a ratio of the width of the respective webs to the width of the respective interconnects is in a range between 1:6 and 1:12.

* * * * *